United States Patent [19]

Cook et al.

[11] 4,000,483

[45] Dec. 28, 1976

[54] LOW VOLTAGE POWER TRANSFORMER

[75] Inventors: Albert Norman Cook, Madison; Jack Brown, Union; Boleslaw Kornatowski, Elizabeth, all of N.J.

[73] Assignee: The Singer Company, New York, N.Y.

[22] Filed: June 24, 1976

[21] Appl. No.: 699,733

[52] U.S. Cl. ..... 336/98; 336/192; 336/198

[51] Int. Cl.[2] ..... H01F 27/30

[58] Field of Search ..... 336/90, 92, 98, 192, 336/198, 208, 209; 310/194; 242/118.41

[56] References Cited

UNITED STATES PATENTS

| | | | |
|---|---|---|---|
| 3,750,072 | 7/1973 | Weiner | 336/208 X |
| 3,750,073 | 7/1973 | Okano | 336/198 |
| 3,781,741 | 12/1973 | Weiner | 336/198 X |
| 3,909,761 | 9/1975 | Miles | 336/208 X |

*Primary Examiner*—Thomas J. Kozma

*Attorney, Agent, or Firm*—Edward L. Bell; Robert E. Smith; Edward P. Schmidt

[57] ABSTRACT

A transformer comprising a stack of sheet metal laminations; an insulating plastic bobbin on which a primary coil is wound; an insulating plastic bobbin on which the secondary coil is wound; and two interengaging insulating plastic covers which enclose the primary coil and provide additional insulation between the primary coil and the laminations and between the primary and secondary coils, while also providing a strain relief for the primary leads from the primary coil. The plastic components are formed to provide two mms of insulation between the primary and secondary coils, and between the primary coil and the laminations. The plastic components are arranged to provide at least 10 mms of "creepage" distance between primary and secondary coils and at least 8mms between the primary coil and the laminations. The insulation provided is sufficient to permit the steel laminations to be mounted directly on the metal frame of an appliance.

3 Claims, 7 Drawing Figures

*Fig. 1*

LOW VOLTAGE POWER TRANSFORMER

BACKGROUND OF THE INVENTION

This invention relates in general to a low voltage power transformer, for inducing low voltage and for providing alternating current, that is uniquely constructed to enable it to be inexpensively manufactured while at the same time meeting stringent requirements of various regulatory agencies for reinforced insulation which is permissible construction for double insulated, safety extra low voltage.

Increasingly, modern day appliances are constructed using low voltage transformers for many purposes including as lighting transformers or to supply power to electronic components. Thus there are available low voltage power transformers which use a plastic bobbin for the primary winding and a separate plastic bobbin for the secondary winding, and those which include insulating frames which assemble over the wound primary bobbin to increase "creepage" distance. However the previous designs of which we are aware require either the use of additional insulation for the core, or of an adequate air space and/or insulation between the transformer core laminations and the metal frame of the appliance. Some of these prior art constructions therefore, have the disadvantage of limited heat dissipation from the transformer. What is required is a transformer design capable of improved heat dissipation which would enable a savings in magnetic core and in conductive material to be realized; as well as a design which would lend itself to economical manufacture by multiplying the function of the various parts thereby to reduce the manufacturing cost of the transformer.

SUMMARY OF THE INVENTION

The above requirements are satisfied in a transformer design having sufficient insulation to meet the requirements of many regulatory agencies as double insulation able to withstand high voltage between the primary coil and the secondary coil, and between the primary coil and the core laminations; as well as having sufficient "creepage" distance to withstand high voltage between the primary coil and the secondary coil and between the primary coil and the core laminations. In the invention the primary bobbin is fashioned in a rectangular form from an insulating plastic material with a rectangular central portion adapted to be supported on the center leg of an E-lamination. The central portion of the primary bobbin supports a first flange spaced from the common leg of the E-lamination and a second flange on the opposite extremity of the central portion spaced from the first flange to define therebetween a winding space. The central portion of the primary bobbin has a cross section of sufficient thickness to meet the requirements of the regulatory agencies for reinforced insulation between the primary winding and the center leg of the E-lamination. A pair of cover elements, also fashioned from an insulating plastic material, are situated between the primary bobbin and the outer legs of the E-lamination, and enclose the primary bobbin with interengaging leaves spaced from the outer legs of the E-lamination. The thickness of the cover element about the primary bobbin is also sufficient to qualify as reinforced insulation between the primary winding and the outer legs of the E-lamination. The pair of cover elements are further formed with lateral extensions on one end to project between the first flange of the primary bobbin and common leg of the E-lamination to the central portion of the primary bobbin. Thus the primary winding is separated from the common leg of the E-lamination by the combined thickness of the first flange of the primary bobbin and the lateral extensions of the cover element. The pair of cover elements are also fashioned with a second pair of inwardly projecting webs in substantial alignment with the E-lamination, which webs are in congruence with the second flange of the primary bobbin and form therewith a seat for the secondary bobbin. The second flange of the primary bobbin is further fashioned with a pair of upstanding fins on the periphery thereof, which fins terminate at the webs of the cover element at locations furtherest from the windings. Thus a first flange of the secondary bobbin rests atop the webs of the cover elements and a second flange of the primary bobbin to provide insulation of the primary windings from the secondary windings equal to the combined thicknesses of the flanges. Additionally the webs of the cover elements and the upstanding fins of the second flange of the primary bobbin provide additional "creepage" distance between the primary winding and the secondary winding.

The cover elements may incorporate a strain relief device for the leads from the primary windings. Extensions to the cover elements are provided to retain the secondary bobbin in oriented relationship with the primary bobbin and to provide an integral coil arrangement facilitating assembly of the E-laminations. While serving, with the primary bobbin, to increase the creepage distance between primary and secondary windings, the cover elements also provide a degree of mechanical protection for the fine gauge primary windings. The completed transformer assembly may have the laminations thereof directly connected to the metal frame of the appliance, which then becomes a heat sink therefore.

BRIEF DESCRIPTION OF THE DRAWINGS

Further advantages and uses of the invention will become more apparent when considered in view of the following detailed description and drawings in which;

Referring to FIG. 1, there shown an exploded perspective view of the transformer of this invention including E-laminations 10 and I-laminations 11. The E-laminations 10 are fashioned with a center leg 14 and outer legs 13, 15 joined by a common leg 16. Also shown in FIG. 1 is a rectangular primary bobbin 20, partially in section and with primary windings 21 cut away, to show details thereof. The primary bobbin 20 is fashioned with a central portion 22 having a rectangular opening 23 therethrough to accommodate the center leg 14 of the E-laminations 10, with the axis of the opening 23 and the center leg 14 being essentially coincident. Spaced inwardly of one extremity 24 of the central portion 22 is a first flange 25, which is partially broken away to show the extremity. The first flange 25 is provided with a cutout 26, through which leads to the primary winding 21 may be brought, as will be explained below. The primary bobbin 20 is fashioned at the opposite extremity 27 of the central portion 22 with a second flange 28. Opposed peripheral edges 29 of the second flange 28 may be sloped, rabbeted or otherwise contoured for a purpose which will be explained below. The peripheral edges of the second flange 28 adjacent to the opposed peripheral edges 29 are fashioned with upstanding fins 30 extending parallel to the E-laminations 10. The primary winding 21 is accommodated on the central portion 22 between the first flange 25 and the second flange 28 of the primary bobbin 20.

Figure 1A:
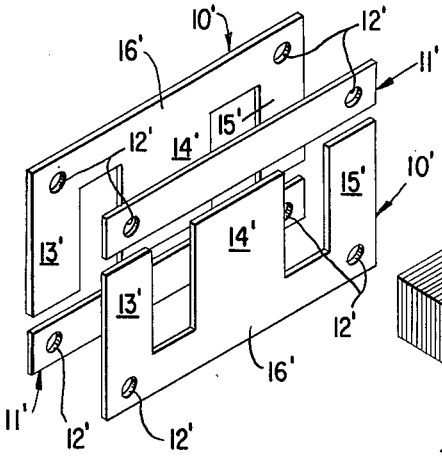
FIG. 1*a* is an exploded perspective view of a portion of the magnetic core shown in FIG. 1 indicating an alternate method of fabrication.

Situated atop the primary bobbin 20 is a rectangular secondary bobbin 35 having a portion of secondary winding 42 cut away to reveal the central portion 36 of the secondary bobbin. As in the primary bobbin 20 the central portion 36 of the secondary bobbin 35 is fashioned with a rectangular opening 37 accommodate accomodate the center leg 14 of the E-laminations 10. The central portion 36 of the secondary bobbin 35 supports on one extremity a first flange 39, and on the opposite extremity a second flange 40, defining therebetween a winding space for the secondary winding 42 of the transformer. The first flange 39 of the secondary bobbin 35 rests on the second flange 28 of the primary bobbin 20 and is accommodated between the fins 30 on the second flange 28. An opening 41 is provided on the second flange 40 of the secondary bobbin 35 through which the internal lead 43 of the secondary winding 42 may be brought. The second flange 40 of the secondary bobbin 35 is somewhat larger than the first flange 39 and has, on the upper surface thereof adjacent the opening 41, an upstanding lug 45 having three passageways 44 through which leads may pass. The second flange 40 of the secondary bobbin 35 is further fashioned with three slots 46 in a peripheral edge adjacent the upstanding lug 45, The slots being aligned with the passageways 44 in the lug. Thus the internal lead 43 of the secondary winding 42 may be brought through the opening 41 and a passageway 44 in the upstanding lug 45, through an aligned slot 45 in the peripheral edge of the second flange 40, beneath the second flange to an adjacent slot 46 and through the second slot. The external lead 47 of the secondary winding 42 may pass through the third slot 46 and together with the internal lead 43 of the secondary winding may be connected to electrical apparatus as required (See FIGS. 2 and 3).

Figure 1:
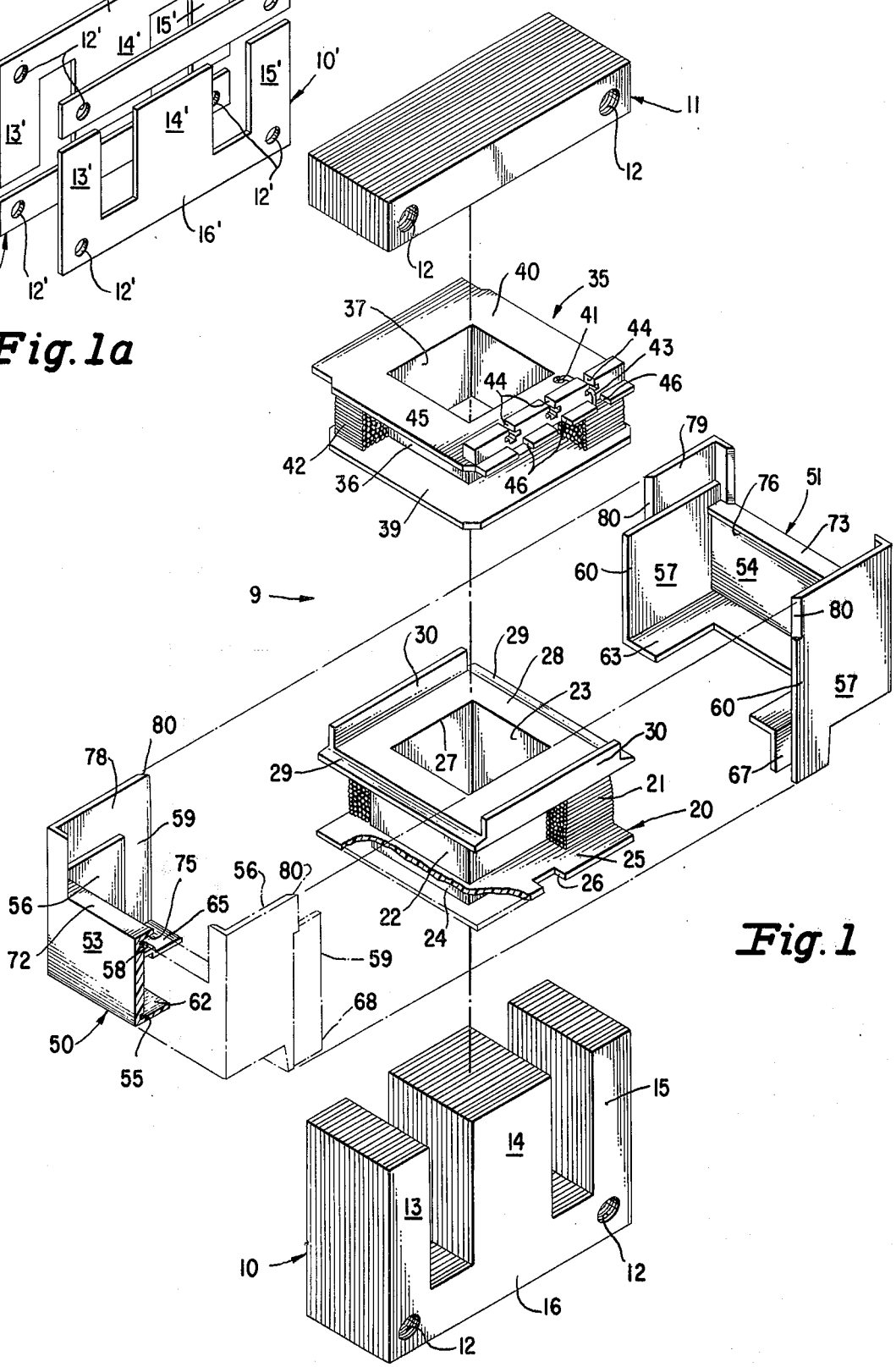
FIG. 1 is an exploded perspective view of the transformer of the invention.

In FIG. 1 may also be seen a pair of cover elements 50, 51. The cover element 50 is formed with a thickened endwall 53 and sidewalls 56. The cover element 51 is similarly formed with thickened endwall 54 and sidewalls 57. The sidewalls 56 of cover element 50 are further fashioned with thinner portions 59 which interleave with thinner portions 60 of the sidewalls 57 of the cover element 51; the endwalls 53, 54 sidewalls 56, 57 and interleaved portions 59, 60 forming a thick wall enclosure around the primary bobbin 20. The cover element 51 has on the bottom of the endwall 54 and sidewalls 57 thereof a lateral extension 63 extending inwardly to the extremity 24 of the central portion 22 of the primary bobbin 20. The cover element 50 similarly has at the bottom of the endwall 53 and sidewalls 56 a lateral extension 62 extending to the extremity 24 of the central portion 22 of the primary bobbin 20. A portion 65 of the lateral extension 62 is depressed to extend beneath the lateral extension 63 on the cover element 51 in overlapping arrangement.

Part of the flange 63 and the thin portion 60 of sidewall 57 of the cover element 51 is formed with a channel 67 adjacent to and aligned with the cutout 26 on the primary bobbin 20. Similarly a part of the flange 62 and thin portion 59 of sidewall 56 of the cover element 50 is fashioned with a second channel 68 also adjacent to and aligned with the cutout 26 on the primary bobbin 20. Thus when the cover elements 50, 51 encircle the primary bobbin 20, and the thin portion 59 of the sidewall 56 is interleaved with the thin portion 60 of the sidewalls 57, an opening 70 formed by channels 67, 68 remains (See FIG. 4). Insulated leads 71 from the primary winding 21 supported on the primary bobbin 20 may be brought through the cutout 26 in the first flange 25 and through the opening 70, which acts as a strain relief therefore, to be connected to the main source of power.

The endwalls 53, 54 of the cover elements 50, 51, respectively, are further fashioned with inwardly directed webs 72, 73, respectively. The inner sides 75, 76 of webs 72, 73 are contoured to lie contiguous the opposed peripheral edges 29 of the second flange 28 of the primary bobbin 20 in congruence therewith. Thus, the innersides 75, 76 may be sloped to be congruent with the sloped opposed peripheral edges 29 on the second flange 28 of the primary bobbin 20, or may be otherwise contoured to be in congruence therewith. The webs 72, 73 are dimensioned to terminate at the fins 30 on the second flange 28 of the primary bobbin 20. As is apparent in FIG. 2, the secondary bobbin 35 rests on the second flange 28 of the primary bobbin 20 and on the outer sides of webs 72, 73.

The cover elements 50, 51 are further fashioned with extensions 78, 79 to the sidewalls 56, 57, respectively, of reduced thickness. The extensions 78, 79 have beveled edges 80, which abut one another when the cover elements 50, 51 are positioned about the primary bobbin 20. A portion of the endwalls 53, 54 closely adjacent the sidewall 56, 57 are also extended thereby to provide with the extension 78, 79, a receptacle for the secondary bobbin 35 within the cover elements.

Thus a primary bobbin 20 having the primary windings 21 thereon may have cover elements 50, 51 enclosing the primary winding, and a secondary bobbin 35 having the secondary windings 42 thereon may be received in the extensions 78, 79 to the sidewalls 56, 57 of the cover elements to form a unitary transformer coil assembly 9. The transformer coil assembly 9 may be installed on the center leg 14 of the E-laminations 10, and the I-laminations 11 may be joined to the E-laminations 10 to form the completed transformer assembly.

In FIG. 1*a* is shown a second method for fabricating a magnetic core where the E-lamina 10′ and I-lamina 11′ are alternately inverted as shown; an entire assembly of a multiplicity of laminae being held together by the friction generated by 4 pairs of nuts and bolts (not shown) extending through the holes 12 in the laminae and clamping the laminae together.

Figure 2:
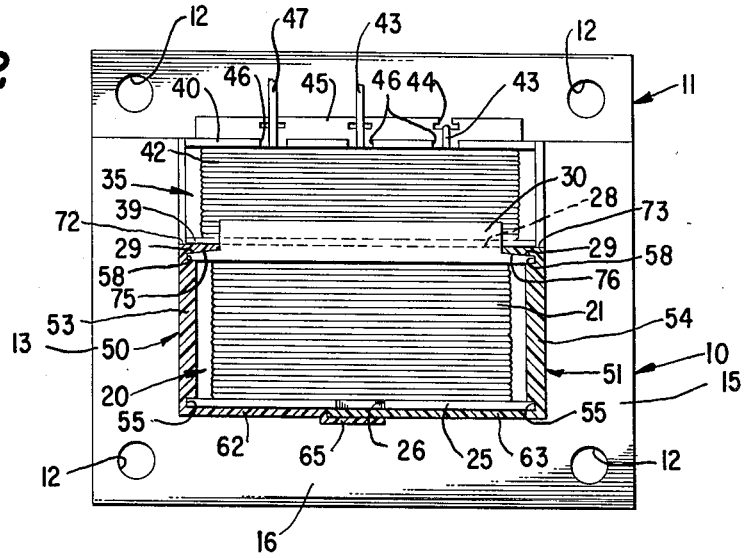
FIG. 2 is a frontal view of the assembled transformer partially in section to show details of the construction.
Figure 3:
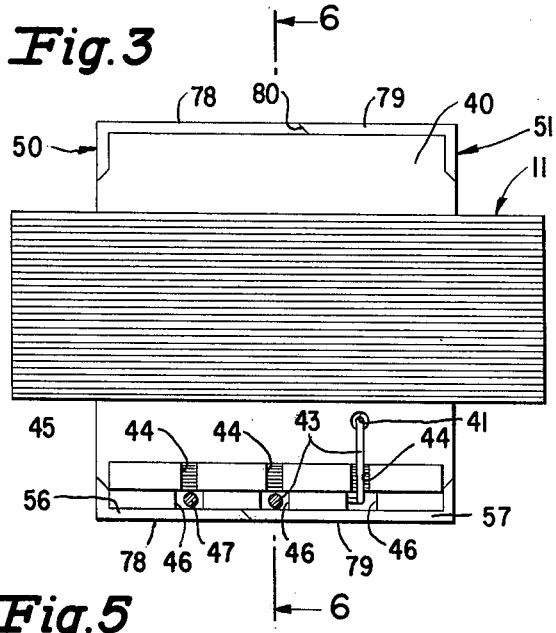
FIG. 3 is a view of the transformer in plan from the secondary side thereof.
Figure 4:
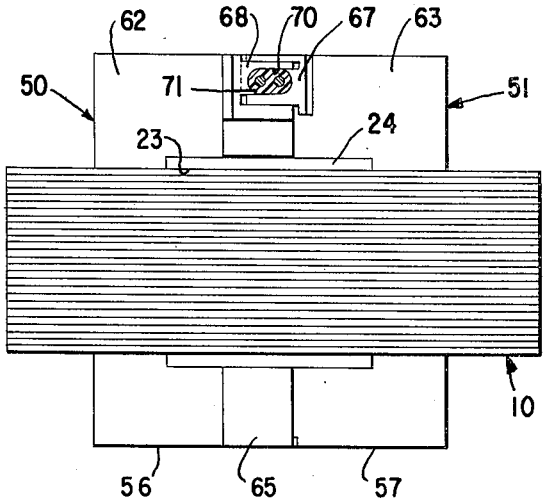
FIG. 4 is a view of the transformer in plan from the primary side thereof.
Figure 5:
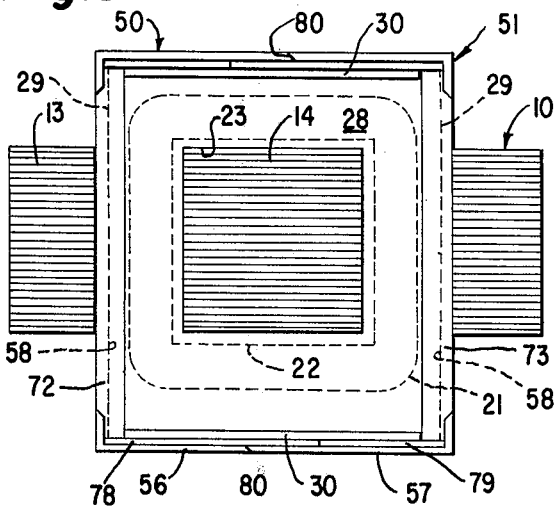
FIG. 5 is a view corresponding to FIG. 3 but with the I-lamination and the secondary bobbin removed; and, FIG. 6 is a section taken substantially along line 6—6 of FIG. 3.
Figure 6:
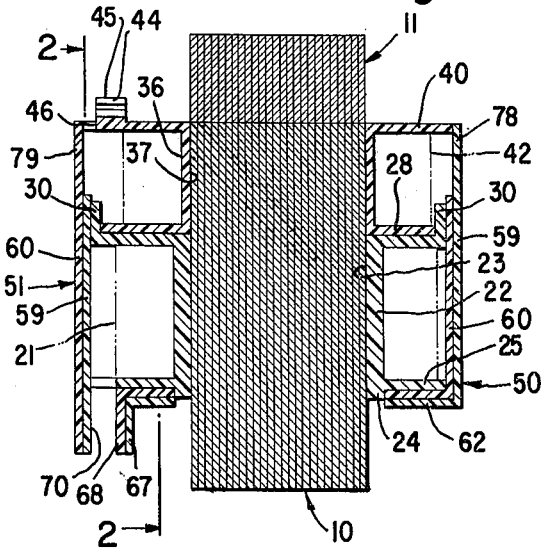

In FIGS. 2 to 6 pertinent details of the assembled transformer may be seen. In the partial section shown in FIG. 2 the thickened cross section of the endwalls 53, 54 of the cover elements 50, 51, which provide the insulation for the primary windings 21 from the outer legs 13, 15 of the E-laminations 10, may be seen. The lateral extensions 62, 63 on the cover elements 50, 51 underlie the first flange 25 of the primary bobbin to provide, with the first flange, extra thick insulation between the primary winding 21 and common leg 16 of the E-laminations. Also apparent in FIG. 2 is a groove 55 in the endwalls 53, 54 of the cover elements 50, 51, which groove receives the first flange 25 of the primary bobbin 20; and the groove 58 in the endwalls which receives the opposed peripheral edges 29 of the second flange 28 of the primary bobbin which extend beneath the webs 72, 73 of the cover elements. Visible in FIGS. 2 and 4 is the portion 65 of the lateral extension 62 of the cover element 50 which projects beneath the lateral extension 63 on the cover element 51 in overlap thereto. It will be evident from an inspection of FIGS. 2 and 4 that the lateral extensions 62, 63 of the cover elements 50, 51, respectively, extend to the extremity 24 of the central portion 22 of the primary bobbin 20 thereby providing large over surface creepage distance and extra thick insulation from the primary winding 21 to the common leg 16. It will also be noted in FIG. 2 that the webs 72, 73 are contiguous the opposed peripheral edges 29 of the second flange 28 of the primary bobbin 20 and the first flange 39 of the secondary bobbin 35, and that the webs terminate at the fins 30 on the second flange 28 of the primary bobbin 20. Thus, in the direction aligned with the E-laminations 10, a large over surface creepage distance has been provided between the primary winding 11 and the secondary winding 42 by inserting webs 72, 73 of cover elements 50, 51 between the primary bobbin 20 and the secondary bobbin 35. In a direction transverse to the E-laminations 10, as is shown in FIG. 6, the upstanding fins 30 on the second flange 28 of the primary bobbin 20 also provide large over surface creepage distance between the primary winding 21 and the secondary winding 42. Referring to FIG. 5 which is a view in plan of the E-laminations 10 supporting the primary bobbin 20 with the primary windings 21 thereon and the cover elements 50, 51 in place but without the secondary bobbin 35 on the I-lamination 11, the distance from the intersection of the abutting upright fins 30 on the second flange 28 of the primary bobbin 20 and the webs 72, 73 of the cover elements 50, 51 to the primary winding 21 may be noted. The over surface "creepage" distance is the sum of the diagonal measurements from the windings to the intersection plus the thickness of the second flange 28 of the primary bobbin 20 and the first flange 39 of the secondary bobbin 35. Thus, advantage has been taken of the increased spacing available at the diagonals of the rectangular bobbins and windings by locating the intersection of the fins 30 and webs 72, 73 in that area.

Referring to FIG. 3 it may be seen that the secondary bobbin 35 is received within the extensions 78, 79 to the sidewalls 56, 57 of the cover elements 50, 51. Also apparent in FIG. 3 is the secondary lead arrangement wherein the internal lead 43 of the secondary winding 42 passes through opening 41 in the second flange 40 of the secondary bobbin 35, through a slot 46 in the periphery of the second flange and up a second slot in the second flange. The external lead 47 of the secondary winding 42 may also be taken through a third slot 46 in the periphery of the second flange 40. The engagements of the bevels 80 on the extension 78, 79 to the sidewalls 56, 57 of the cover elements 50, 51 are also apparent in FIG. 3.

In FIG. 4 the opening 70 remaining for passage of the insulated primary leads 71 after engagement of the channels 68, 67 on the cover elements 50, 51, respectively, are clearly seen. Further details of this arrangement are also apparent in FIG. 6. An inspection of FIG. 6 will, show the thickness of the insulation, formed by interleaved portions 59, 60 of the cover elements 50, 51 respectively, enclosing the primary bobbin; between the primary winding 21 and the E-lamination 10; and between the primary winding and the secondary winding 42. The insulation between the primary winding 32 and the outside of the cover elements 50, 51 also serve to protect the fine gauge wire of the primary winding.

Thus a transformer assembly has been disclosed wherein the primary and secondary bobbins 20, 35 and cover elements 50, 51 provide, singly or in combination with each other, sufficient insulation; and provide, in combination with each other, sufficient "creepage" distance to meet the requirements of the various regulatory agencies for "reinforced insulation" which is permissable construction for double insulated, safety extra low voltage. In addition cover elements 50, 51 provide a strain relief function for the leads 71 from the primary windings 21, and provide a receptacle for the secondary bobbin 35. The secondary bobbin 35, further, has means thereon for bringing out and guiding the internal lead 43 and external lead 47 of the secondary winding 42. The above desideratum has been achieved by using components which are not difficult to manufacture and can be made without any sacrifice to the strength of the various components. A transformer assembly so constructed may have the laminations thereof directly supported on the metal frame of an appliance with the approval of the various regulatory agencies, resulting in improved heat dissipation; which, further, lends itself to economical manufacture.

Having thus set forth the nature of the invention what is sought to be claimed is:

1. A transformer comprising:

a. a magnetic core having a center and outer legs joined by substantially parallel first and second common legs on either end thereof;

b. a rectangular high voltage bobbin fashioned from an insulating material and having a central portion supported on said center leg of said core and sharing a common axis therewith, said central portion having a thickened cross section adjacent said center leg and supporting a rectangular first flange spaced from said first common leg and a rectangular second flange spaced from said first flange defining therebetween a winding space for accommodating a high voltage winding, said rectangular second flange having a peripheral edge formed with a pair of fins on opposite sides thereof in substantial alignment with said common legs of said core and extending away from said winding space from substantially one diagonal of said rectangular second flange to the other diagonal thereof, said rectangular second flange having a shaped surface extending from said fins to said peripheral edge on sides adjacent said opposite sides;

c. a low voltage bobbin fashioned from an insulating material and having a central core portion supported on said common leg of said core proximate said high voltage bobbin, said central core portion having a first and second flange on opposite ends thereof defining a winding space therebetween for accommodating a low voltage winding, said first flange being situate between said fins on said second flange of said high voltage bobbin;

d. a pair of cover elements fashioned from an insulating material and situated within said outer legs of said core, each of said cover elements having a thickened cross section enclosing said high voltage bobbin adjacent said outer legs of said core and thinner cross sections overlapped with each other in locations spaced from said outer legs to form a thickened cross section, each of said cover elements being formed with a web extending between said high voltage and said low voltage bobbin to said fins on said second flange of said high voltage bobbin, said web having a surface congruent to and contiguous said shaped surface of said second flange of said high voltage bobbin, each of said cover elements being further formed with a flange extending between said first flange of said primary bobbin and said first common leg of said core to said central portion of said primary bobbin.

2. In a transformer as claimed in claim 1 wherein said first flange of said high voltage bobbin is formed with an opening in said first flange to accommodate the passage of high voltage leads from said high voltage winding and wherein said cover elements are formed with strain relief means aligned with said opening and engageable with said high voltage leads.

3. In a transformer as claimed in claim 2 wherein said cover elements include extensions thereto for receiving said low voltage bobbin.

* * * * *

UNITED STATES PATENT OFFICE

CERTIFICATE OF CORRECTION

Patent No. 4,000,483 Dated December 28, 1976

Inventor(s) Albert N. Cook et al.

It is certified that error appears in the above-identified patent and that said Letters Patent are hereby corrected as shown below:

Column 3, line 24, after "37", insert -- to --

Column 3, line 25, delete "accomodate"

Column 3, line 47, "45" (second occurrence) should be -- 46 --

Column 5, line 30, "winding 11" should be -- winding 21 --

Signed and Sealed this

*fifth* Day of *July 1977*

[SEAL]

*Attest:*

RUTH C. MASON
*Attesting Officer*

C. MARSHALL DANN
*Commissioner of Patents and Trademarks*